US005154998A

United States Patent [19]

Aoki et al.

[11] Patent Number: 5,154,998

[45] Date of Patent: Oct. 13, 1992

[54] TONER FOR DEVELOPING ELECTROSTATICALLY CHARGED IMAGES

[75] Inventors: Nobuyuki Aoki; Masamoto Terao, both of Shizuoka, Japan

[73] Assignee: Tomoegawa Paper Co., Ltd, Tokyo, Japan

[21] Appl. No.: 606,483

[22] Filed: Oct. 31, 1990

[30] Foreign Application Priority Data

Nov. 8, 1989 [JP] Japan ..... 1-288726

[51] Int. Cl.[5] ..... G03G 9/087

[52] U.S. Cl. ..... 430/105; 430/106.6

[58] Field of Search ..... 430/106, 109, 110, 105, 430/106.6

[56] References Cited

U.S. PATENT DOCUMENTS

| | | | |
|---|---|---|---|
| 4,265,991 | 5/1981 | Hirai et al. | 430/64 |
| 4,265,992 | 5/1981 | Kouchi et al. | 430/107 |
| 4,698,290 | 10/1987 | Berkes | 430/124 |
| 5,023,158 | 6/1991 | Tomono et al. | 430/110 |
| 5,045,423 | 9/1991 | Weber et al. | 430/110 |

*Primary Examiner*—John Goodrow

*Attorney, Agent, or Firm*—Scully, Scott, Murphy & Presser

[57] ABSTRACT

A toner for developing electrostatically charged images is disclosed including a binder resin and a coloring agent as principal ingredients, the toner containing ethylene/-methyl methacrylate copolymer resin in an amount of 1% by weight to 30% by weight based on the total weight of the toner.

10 Claims, No Drawings

TONER FOR DEVELOPING ELECTROSTATICALLY CHARGED IMAGES

BACKGROUND OF THE INVENTION

1. Field of the Invention

The present invention relates to a toner for developing electrostatically charged images. More particularly, it relates to an electrostatic toner having improved fixing in a hot roll fixing copy system, and further relates to prevention of copy quality deterioration in copy machines equipped with an automatic double sided copy device or an automatic sorter device.

2. Prior Art

Heretofore, copy machines including a thermal fixing system need to have at least a definite fixing strength for the toner used therein.

Copy machines, especially those equipped with an automatic double sided copy device or an automatic sorter have disadvantages such that double sided copies have poor quality and that in the case where the copies are sorted in an automatic sorter, the back sides of the copies become smudged when the fixing strength of the toner is not properly adjusted. In order to solve such disadvantages, toners containing polyethylene wax, natural wax such as carnauba wax or the like, ethylene/-vinyl acetate copolymer, and the like have been employed.

These conventional toners containing polyethylene wax or natural wax cause so-called filming, which is the result of wax fixing to the surface of the carrier or the sensitizing material to become a film due to the failure of dispersion of the wax in the binder resin, or due to the elimination of the wax. The filming causes various effects such as smudged images and the like.

In addition, these conventional toners containing ethylene/vinyl acetate copolymer have a disadvantage such that the storage stability of the toner sometimes deteriorates (the powder material is blocking at the elevated temperature) due to ethylene/vinyl acetate copolymer fixing itself.

SUMMARY OF THE INVENTION

In order to solve the problems described above, it is an object of the present invention is to provide a toner for developing electrostatically charged images comprising a binder resin and a coloring agent as principal ingredients, the toner containing ethylene/methyl methacrylate copolymer resin in an amount of 1% by weight to 30% by weight based on the total weight of the toner.

The electrostatic toner according to the present invention has good fixing strength, is suitable for double sided copies, and affords a good quality copy since the electrostatic toner includes ethylene/methyl methacrylate copolymer resin having flexibility as well as the conventional ethylene/vinyl acetate copolymer resin has.

The above objects, effects, features, and advantages of the present invention will become more apparent from the following description of preferred embodiments thereof.

DETAILED DESCRIPTION OF THE INVENTION

According to the present invention, ethylene/methyl methacrylate copolymer resin must be present in the electrostatic toner in an amount of 1% by weight to 30% by weight based on the total weight of the toner. If the amount of ethylene/methyl methacrylate copolymer resin is below 1% by weight, the quality of double side copies does not improve and poor quality results in the automatically sorted copies. On the other hand, ethylene/methyl methacrylate in an amount of above 30% by weight results in a toner with impaired storage stability.

Especially, the amount of the methyl methacrylate ingredient is preferably 10% by weight to 50% by weight based on the weight of ethylene/methyl methacrylate copolymer. If the amount of the methyl methacrylate ingredient is below 10% by weight, the hardness of the fixed image is much decreased. On the other hand, if the amount of methyl methacrylate is above 50% by weight, the fixed image is sufficiently hard, but the toner tends to be brittle.

Next, each ingredient of the electrostatic toner according to the present invention will be described in detail.

[Binder Resin]

Suitable binder resin for the electrostatic toner according to the present invention includes, for example, styrene monomers or substituted styrene monomers such as polystyrene, poly-p-chlorostyrene, polyvinyltoluene, and the like; styrene copolymers such as styrene/p-chlorostyrene copolymer, styrene/propylene copolymer, styrene/vinyltoluene copolymer, styrene/-vinylnaphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/methyl α-chloromethacrylate copolymer, styrene/acrylonitrile copolymer, styrene/vinyl methyl ether copolymer, styrene/vinyl ethyl ether copolymer, styrene/vinyl methyl ketone copolymer, styrene/butadiene copolymer, styrene/isoprene copolymer, styrene/acrylonitrile/indene copolymer, styrene/maleic acid copolymer, styrene/maleic acid ester copolymer, and the like; polymethyl methacrylate; polybutyl methacrylate; polyvinylchloride; polyvinyl acetate; polyethylene; polypropyrene; polyester; polyurethane; polyamido; epoxy resin; polyvinyl butyral; polyamide; polyacrylic acid resin; rosin; modified rosin; terpene resin; phenol resin; aliphatic hydrocarbons resin; alicyclic hydrocarbons resin; aromatic petroleum resin; chlorinated paraffin; paraffin wax; and the like. The materials mentioned above may be used alone or in combination. Among these materials, styrene/acrylic acid ester group copolymer resin is especially compatibility with ethylene/methyl methacrylate copolymer resin. Using styrene/acrylic acid ester group copolymer resin as a binder resin has the advantages of a more efficient thermal fusion kneading step, improved image characteristics, and the like.

Coloring Agent

Suitable coloring agents include carbon black, nigrosine dye stuff (C. I. No. 50415B), aniline blue (C. I. No. 50405), chalco oil blue (C. I. No. azoec Blue 3), chrome yellow (C. I. No. 14090), ultramarine blue (C. I. No. 77103), Dupont oil red (C. I. No. 26105), quinoline yellow (C. I. No. 47005), methylene blue chloride (C. I. No 52015), copper phthalocyanine blue (C. I. No. 74160), malachite green oxalate (C. I. No. 42000), lamp black (C. I. No. 77266), rose bengal (C. I. No. 45435), the mixture thereof, and the like. These coloring agents should be present in the electrostatic toner in sufficient quantity such that the image is satisfactorily dense. The coloring agent is normally present in an amount of 1 part by weight to 20 parts by weight per 100 parts by weight of the binder resin.

Additives

Various additives are added to the electrostatic toner of the present invention as necessary. Examples of additives include charge control agents, offset resisting agents, and the like. As an offset resisting agent, for example, polyolefins having a softening point of 80° C. to 180° C. measured by the ring and ball method, especially, polypropylene is effective.

In addition, the electrostatic toner of the present invention can be applied to one-ingredient toners containing magnetic materials. The magnetic materials include a ferromagnetic metal such as iron, cobalt, nickel, or the like; an alloy such as ferrite, magnetite, or the like; an alloy including no ferromagnetic element which exhibits ferromagnetism after it is subjected to a suitable heat treatment, for example, manganese-copper-aluminum, manganese-copper-lead, hoislar alloy containing manganese and copper; chromium dioxide, and the like. These magnetic materials should be fine powders, each powder having an average particle size of 0.1 μm to 1 μm and which can be dispersed uniformly in the binder resin. The magnetic materials should be present in an amount of 20 parts by weight to 70 parts by weight, preferably 40 parts by weight to 70 parts by weight per 100 parts by weight of the electrostatic toner.

Examples

The present invention will be explained in detail hereinbelow with reference to example. In the examples, all "parts" are by weight.

EXAMPLE 1

Styrene/acrylic acid ester copolymer 100 parts
(styrene/methyl methacrylate/butyl acrylate =80/5/15, Mw=19×10⁴)
Metal containing dye 1 part
("BONTRON S-34", produced by ORIENT CHEMICAL INDUSTRIES CO., LTD.)
Carbon black: 5 parts
("MA-100", produced by MITSUBISHI CHEMICAL INDUSTRIES CO., LTD.)
Ethylene/methyl methacrylate copolymer resin: 5 parts
("ACRYFT WD201", containing methyl methacrylate in an amount of 10% by weight based on the copolymer resin, produced by SUMITOMO CHEMICAL CO., LTD.)

The mixture of the above-described compositions was heat-melted and kneaded. The kneaded mixture was pulverized and graded by an extruding machine to obtain negative-chargeable toner particles having an average particle size of 13 μm.

EXAMPLE 2

Styrene/acrylic acid ester copolymer: 100 parts (styrene/methyl methacrylate/butyl acrylate =80/5/15, Mw=19×104)
Metal containing dye:, 1 part
("BONTRON S-34", produced by ORIENT CHEMICAL INDUSTRIES CO., LTD.)
Carbon black: 5 parts
("MA-100", produced by MITSUBISHI CHEMICAL INDUSTRIES CO., LTD.)
Ethylene/methyl methacrylate copolymer resin: 5 parts
("ACRYFT WH202", containing methyl methacrylate in an amount of 20% by weight based on the copolymer resin, produced by SUMITOMO CHEMICAL CO., LTD.)

The mixture of the above-described compositions was heat-melted and kneaded. The kneaded mixture was pulverized and graded by an extruding machine to obtain negative-chargeable toner particles having an average particle size of 13 μm.

EXAMPLE 3

Styrene/acrylic acid ester copolymer: 100 parts
(styrene/methyl methacrylate/butyl acrylate =80/5/15, Mw=19×10⁴)
Metal containing dye: 1 part
("BONTRON S-34", produced by ORIENT CHEMICAL INDUSTRIES CO., LTD.)
Carbon black: 5 parts
("MA-100", produced by MITSUBISHI CHEMICAL INDUSTRIES CO., LTD.)
Ethylene/methyl methacrylate copolymer resin: 5 parts
("ACRYFT WK505", containing methyl methacrylate in an amount of 28% by weight based on the copolymer resin, produced by SUMITOMO CHEMICAL CO., LTD.)

The mixture of the above-described compositions was heat-melted and kneaded. The kneaded mixture was pulverized and graded by an extruding machine to obtain negative-chargeable toner particles having an average particle size of 13 μm.

COMPARATIVE EXAMPLE 1

An electrostatic toner for comparison was obtained by repeating the same procedures as described in Example 1 except that addition of ethylene/methyl methacrylate copolymer resin was omitted.

COMPARATIVE EXAMPLE 2

An electrostatic toner for comparison was obtained by repeating the same procedures as described in Example 1 except that polyethylene wax (PE-130, produced by HOEXHST JAPAN LIMITED) was used instead of ethylene/methyl methacrylate copolymer resin.

COMPARATIVE EXAMPLE 3

An electrostatic toner for comparison was obtained by repeating the same procedures as described in Example 1 except that carnauba wax was used instead of ethylene/methyl methacrylate copolymer resin.

COMPARATIVE EXAMPLE 4

An electrostatic toner for comparison was obtained by repeating the same procedures as described in Example 1 except that ethylene/vinyl acetate copolymer resin was used instead of ethylene/methyl methacrylate copolymer resin.

COMPARATIVE EXAMPLE 5

An electrostatic toner for comparison was obtained by repeating the same procedures as described in Example 1 except that ethylene/methyl methacrylate copolymer resin was added in an amount of 0.5 parts instead of 5 parts.

COMPARATIVE EXAMPLE 6

An electrostatic toner for comparison was obtained by repeating the same procedures as described in Example 1 except that ethylene/methyl methacrylate copolymer resin was added in an amount of 35 parts instead of 5 parts.

Four parts of each of the electrostatic toners of Examples 1 to 3 according to the present invention and the comparative toners of Comparative Examples 1 to 6 were mixed with 100 parts of a carrier which is ferrite coated by an acryl resin to prepare a two-ingredient developer.

Next, Table 1 shows the evaluation results of the electrostatic toners according to the present invention and the comparative toners with respect to the storage stability and the characteristics for practical use of the toners in the case where each of the developers (toners) was set in a commercial available copy machine (SF-9750, produced by SHARP CORPORATION). The evaluation results shown in Table 1 were obtained by the following tests.

1) Storage stability of toners

After each of the toners was retained at 50° C. for 8 hours, the blocking thereof was evaluated.

OO. . . No blocking was observed.

The toner after storage at 50° C. was the same as that before storage at 50° C.

O. . . The fluidity of the toner was slightly decreased. The fluidity of the toner was decreased.

Δ. . . The fluidity of the toner was decreased. Blocking was observed.

X . . . Blocking was observed. There were problems for practical use.

XX . . . Extreme blocking was observed.

2) Fixing retain index

The fixing images (1 cm wide solid square images) were prepared by changing the fixing unit temperature of the copy machine at 160° C., 180° C., 200° C. Thus formed fixed image parts were each rubbed back and forth three strokes using an eraser rubber testing device at a pressure of 1 Kg/cm2. The densities of the images before and after the rubbing were measured by process measurements Mcbeth RD914. Assuming that the density of the image before the rubbing is A, and that of the image after the rubbing is B, fixing retain index (%) was calculated according to the following equation:

$$\text{Fixing retain index (\%)} = B/A \times 100$$

3) Poor quality of double sided copies

A number of one sided copied papers were stacked and set in the cassette case so that the back sides (uncopied sides) of the copies were to be copied continuously. On the process of feeding the copies in order to be copied on the back sides thereof, the pre-copied images were fixed to the back side (uncopied side) of the next stacked paper due to the pressure of the feed paper roller. The quality of the double sided copies were evaluated.

OO. . . Excellent quality of double sided copies.

O. . . Double sided copies with minor imperfections.

Δ. . . Poor quality of double sided copies. There were no problems for practical use.

X . . . Poor quality of double sided copies. There were problems for practical use.

XX . . . Extremely poor quality of double sided copies.

4) Image density and smudging

The image density and smudging of both the initial stage and the 20,000th copy were measured by process measurements Macbeth RD914.

As will be apparent from the results shown in Table 1, the electrostatic toners of Examples 1 to 3 according to the present invention had good storage stability and stable characteristics as a developer.

It is clear that the fixing property (fixing retain index, poor quality of double sided copy) cannot be improved if the compounding amount of ethylene/methyl methacrylate copolymer resin is below 1% by weight based on the total weight of the electrostatic toner as shown in Comparative Example 5. It is also clear that if ethylene/methyl methacrylate copolymer resin is above 30% by weight based on the total weight of the toner as shown in Comparative Example 6, the toner had a good fixing strength but a poor storage stability. As mentioned above, the electrostatic toner according to the present invention can be applied to the automatic double sided copy device and successible copying with the good quality since the electrostatic toner has both a good storage stability and a high fixing strength which the conventional art cannot achieve.

The present invention has been described in detail with respect to embodiments, and it will now be apparent from the foregoing to those skilled in the art that changes and modifications may be made without departing from the invention in its broader aspects, and it is the invention, therefore, in the appended claims to cover all such changes and modifications as fall with the true spirit of the invention.

TABLE 1

| | | Practical characteristics of the developer | | | | | | | |
|---|---|---|---|---|---|---|---|---|---|
| | Storage stability of the toner | Fixing retain index (%) | | | Poor quality of the double-sided copies | Initial stage | | After 20,000 sheets | |
| | | 160° C. | 180° C. | 200° C. | | Image density | Smudging | Image density | Smudging |
| Example 1 | OO | 65 | 74 | 85 | O | 1.35 | 0.48 | 1.36 | 0.54 |
| Example 2 | OO | 66 | 78 | 88 | OO | 1.34 | 0.50 | 1.35 | 0.60 |
| Example 3 | O | 68 | 80 | 91 | OO | 1.35 | 0.52 | 1.34 | 0.48 |
| Comparative Example 1 | OO | 61 | 70 | 79 | X | 1.35 | 0.54 | 1.34 | 0.56 |
| Comparative Example 2 | O-Δ | 66 | 75 | 86 | Δ | 1.03 | 0.98 | 1.00 | 1.02 |
| Comparative Example 3 | X | 65 | 75 | 87 | O-Δ | 1.29 | 0.80 | 1.33 | 0.98 |
| Comparative Example 4 | XX | 67 | 78 | 88 | OO | 1.35 | 0.54 | 1.35 | 0.55 |
| Comparative | OO | 60 | 71 | 80 | X | 1.33 | 0.57 | 1.33 | 0.58 |

TABLE 1-continued

| | Storage stability of the toner | Practical characteristics of the developer | | | | | | | |
|---|---|---|---|---|---|---|---|---|---|
| | | Fixing retain index (%) | | | Poor quality of the double-sided copies | Initial stage | | After 20,000 sheets | |
| | | 160° C. | 180° C. | 200° C. | | Image density | Smudging | Image density | Smudging |
| Example 5 | | | | | | | | | |
| Comparative Example 6 | XX | 67 | 81 | 92 | ○○ | 1.36 | 0.54 | 1.34 | 0.55 |

What is claimed is:

1. A toner for developing electrostatically charged images comprising a binder resin and a coloring agent as principal ingredients, the toner containing ethylene/-methyl methacrylate copolymer resin in a amount of 1% by weight to 30% by weight based on the total weight of the toner.

2. A toner for developing electrostatically charged images as claimed in claim 1, wherein the ethylene/-methyl methacrylate copolymer resin contains methyl methacrylate in an amount of 10% by weight to 50% by weight based on the weight of the ethylene/methyl methacrylate copolymer resin.

3. A toner for developing electrostatically charged images as claimed in claim 1, wherein the binder resin is at least one material selected from the group consisting of styrene monomers, substituted styrene monomers, styrene copolymers, polymethyl methacrylate, polybutyl methacrylate, polyvinylchloride, polyvinyl acetate, polyethylene, polypropyrene, polyester, polyurethane, polyamido, epoxy resin, polyvinyl butyral, polyamide, polyacrylic acid resin, rosin, modified rosin, terpene resin, phenol resin, aliphatic hydrocarbons resin, alicyclic hydrocarbons resin, aromatic petroleum resin, chlorinated paraffin, and paraffin wax.

4. A toner for developing electrostatically charged images as claimed in claim 3, wherein the binder resin is styrene/acrylic acid ester group copolymer resin.

5. A toner for developing electrostatically charged images as claimed in claim 1, wherein the coloring agent is contained in an amount of 1 part by weight to 20 parts by weight per 100 parts by weight of the binder resin.

6. A toner for developing electrostatically charged images as claimed in claim 1, wherein the coloring agent is at least one material selected from the group consisting of carbon black, nigrosine dye stuff, aniline blue, chalco oil blue, chrome yellow, ultramarine blue, Dupont oil red, quinoline yellow, methylene blue chloride, copper phthalocyanine blue, malachite green oxalate, lamp black, and rose bengal.

7. A toner for developing electrostatically charged images as claimed in claim 1, further comprising a charge control agent.

8. A toner for developing electrostatically charged images as claimed in claim 1, further comprising an offset preventive agent.

9. A toner for developing electrostatically charged images as claimed in claim 1, further comprising a magnetic material in an amount of 20 parts by weight to 70 parts by weight per 100 parts by weight of the electrostatic toner.

10. A toner for developing electrostatically charged images as claimed in claim 9, wherein the magnetic material is in an amount of 40 parts by weight to 70 parts by weight per 100 parts by weight of the electrostatic toner.

* * * * *